US008966672B2

(12) United States Patent
Smith

(10) Patent No.: US 8,966,672 B2
(45) Date of Patent: Mar. 3, 2015

(54) FASTENER FOR LOW PROFILE PROTECTIVE HELMET INTERNAL SUSPENSION PADDING

(76) Inventor: Hosea Smith, Cordon, KY (US)

( * ) Notice: Subject to any disclaimer, the term of this patent is extended or adjusted under 35 U.S.C. 154(b) by 405 days.

(21) Appl. No.: 13/412,775

(22) Filed: Mar. 6, 2012

(65) Prior Publication Data

US 2013/0232669 A1 Sep. 12, 2013

(51) Int. Cl.
*A42B 3/14* (2006.01)

(52) U.S. Cl.
CPC ..... *A42B 3/147* (2013.01)
USPC ..... 2/416

(58) Field of Classification Search
CPC ..... A42B 3/14; A42B 3/142; A42B 3/147
USPC ..... 2/416, 414, 417, 419, 420, 421, 418, 2/182.6, 181.4, 182.2
See application file for complete search history.

(56) References Cited

U.S. PATENT DOCUMENTS

| | | | | | |
|---|---|---|---|---|---|
| 2,585,937 | A * | 2/1952 | Johnson et al. | 2/182.5 |
| 2,795,792 | A * | 6/1957 | Finken | 2/416 |
| 2,853,708 | A * | 9/1958 | Austin | 2/416 |
| 2,858,538 | A * | 11/1958 | Simpson | 2/416 |
| 2,941,209 | A * | 6/1960 | Schoener | 2/416 |
| 3,398,626 | A * | 8/1968 | Storey | 411/531 |
| 3,430,260 | A * | 3/1969 | Johnson et al. | 2/416 |
| 2002/0000004 | A1 * | 1/2002 | Wise et al. | 2/416 |
| 2009/0205113 | A1 * | 8/2009 | Smith | 2/414 |

* cited by examiner

*Primary Examiner* — Amy Vanatta
(74) *Attorney, Agent, or Firm* — Gary K. Price

(57) ABSTRACT

A low profile protective helmet having an outer shell and an interior surface that is immediately adjacent the top of the wearer's head while the helmet is being worn. The interior surface includes a plurality of fasteners that are connectable to a prior art suspension liner. Each of the fasteners is disposed between first and second rib members. Each rib member is a raised ridge in the interior surface that restricts the side-to-side movement of the suspension liner's integral head straps by the retaining action of the rib members as the integral head straps are attached to each fastener.

9 Claims, 4 Drawing Sheets

FASTENER FOR LOW PROFILE PROTECTIVE HELMET INTERNAL SUSPENSION PADDING

CROSS REFERENCES TO RELATED APPLICATIONS

None.

Statement as to rights to inventions made under federally sponsored research and development: Not Applicable.

BACKGROUND OF THE INVENTION

1. Field of the Invention

This invention relates generally to protective helmets and more particularly, to an attachment means for an internal suspension padding within a low profile protective helmet.

2. Brief Description of Prior Art

The use of safety helmets (hard hats) in hazardous areas in industry and mines is widespread. Prior art helmets (referred herein as bulk helmets) are generally heavy and because the shell of the helmet is spaced an appreciable distance from the wearer's head, they are often unstable on the head. In addition, the bulk of these helmets seriously limit head movement by the wearer in the often confined space within the mine. A low profile helmet suitable for use in hazardous areas in industry and mines, say of the type disclosed in U.S. Pat. No. 8,060,951 ('951 patent), or other suitable low profile helmet available is known to overcome these disadvantages of the bulk helmets. The close fit of the low profile protective helmet minimizes the weight of the helmet itself, and provides excellent stability of the helmet on the head.

Technically, safety helmets are constructed of a hard outer shell of strong material, such as metal or plastic. The outer shell includes a crown support that covers the top of the wearer's head. A crown support or suspension padding (sometimes herein referred to as suspension liner), usually of straps, is secured within the shell and fits directly over the wearer's head. The suspension spaces the shell from the wearer's head so that impacts upon the shell are cushioned.

These suspension liners are primarily adopted for the bulk helmets and not immediately adaptable for the low profile protective helmet.

The present invention relates generally to a novel fastening means for appropriately securing prior art suspension liners to low profile protective helmets such as disclosed in the '951 patent. Specifically, the invention is concerned with a suspension means adaptable for use with these low profile helmets in order to stabilize the suspension liner with the low profile design.

As will be seen from the subsequent description, the preferred embodiments of the present invention overcome disadvantages of the prior art.

SUMMARY OF THE INVENTION

A low profile protective helmet having an outer shell of a substantially rigid impact resistant material and an interior surface that is immediately adjacent the top of the wearer's head while the helmet is being worn. The interior surface includes a plurality of fasteners that are spaced along a bottom edge of the helmet. These fasteners are each connectable to the prior art suspension liner and secures the liner within the helmet and further supports the shell in spaced apart relation about the wearer's head.

The fastening means of the present invention includes first and second rib members adjacent each fastener, such that each fastener is disposed between the pair of rib members. Each rib member is a raised ridge in the interior surface that stabilizes the suspension liner. In particular, the rib members restrict the side-to-side movement of the suspension liners integral head straps by the retaining action of the rib members as the integral head straps are attached to each fastener.

DESCRIPTION OF THE PREFERRED EMBODIMENT

Figure 1:
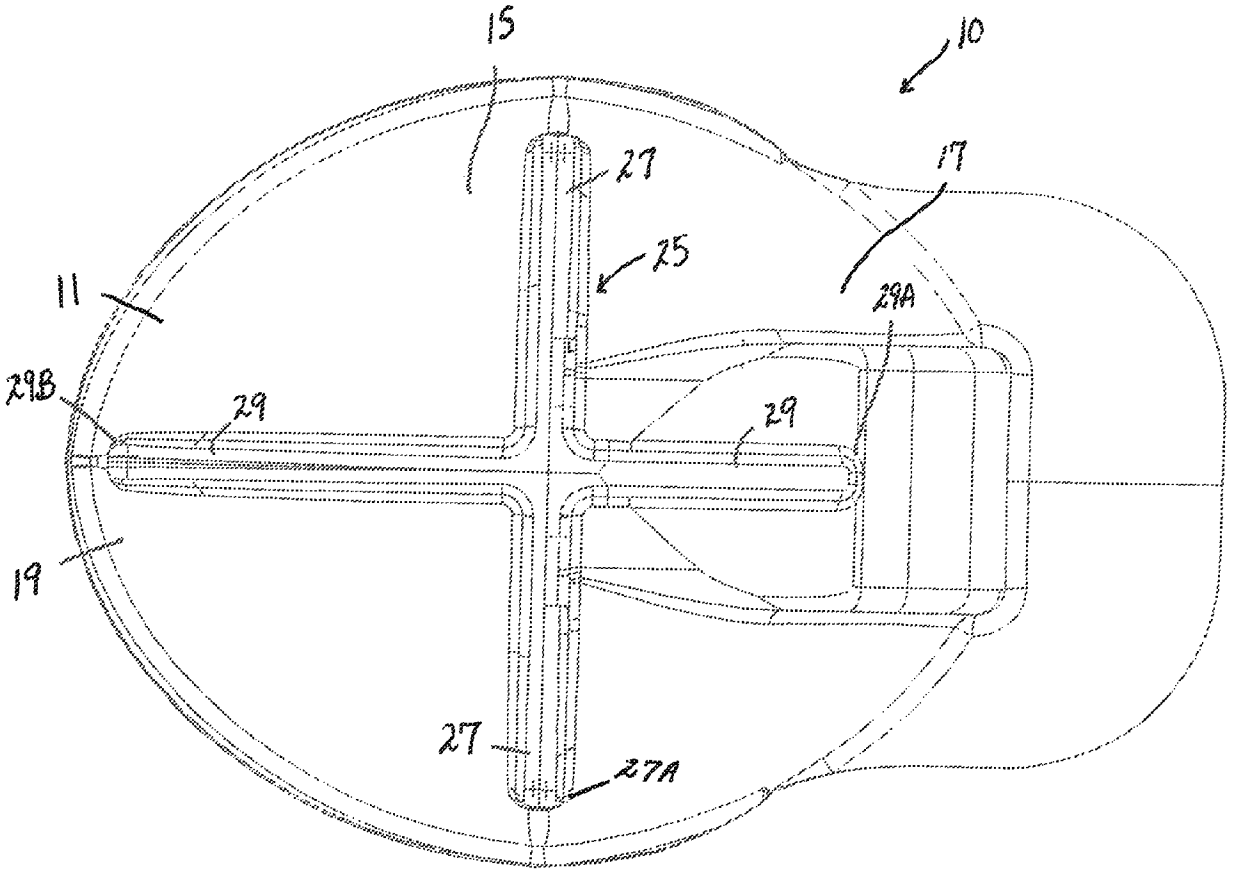
FIG. 1 is a top view of a low profile protective helmet.
Figure 2:
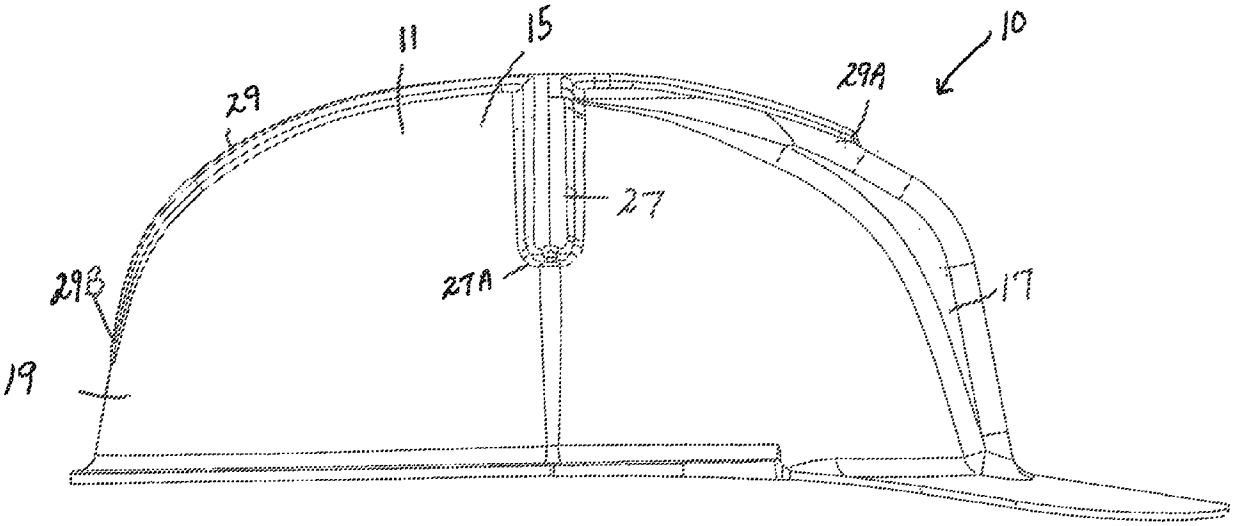
FIG. 2 is a side view of the low profile protective helmet of FIG. 1.

Referring now to the drawings, an assembled low profile protective helmet 10, of the type disclosed in U.S. Pat. No. 8,060,951, or other suitable low profile helmet is shown. The protective helmet 10 includes an outer shell 11 of a substantially rigid impact resistant material. The outer shell 11 having generally spherical contours to encompass the upper part of the wearer's head. The shell 11 is preferably made of a dense, relatively light weight, impact absorbing material such as for example, a polycarbonate plastic.

The outer shell 11 is integrally formed by three sections, a center section 15, a front section 17 and a rear section 19. The center section 15 covers the central portion of the top of the wearer's head from a point above the ear on one side of the head to a point above the ear on the other side of the head. The front section 17 is integral to the center section 15 and covers the upper frontal portion of the head. The rear section 19 is likewise integral to the center section 15 and covers the back of the head. The sides of all three sections are configured to closely fit the head of the wearer in order to better maintain firm contact with the area of the head while the helmet is being worn.

The outer shell 11 includes an interior surface 20 that is immediately adjacent the top of the wearer's head while the helmet is being worn. The interior surface 20 includes a distal point 21 (see FIG. 3) which represents the furthest distance between the top of the wearer's head and the interior surface 20 when the helmet 10 is being worn. The distal point 21 of the low profile helmet 10 is approximately 1.3 inches from the top of the wearer's head which is at least one (1) inch closer to the top of the wearer's head than with prior art bulk hard hats. In particular, the height of the low profile helmet 10 is approximately 4.7 inches in height which is considerably less than prior art bulk helmets. As a result, the design permits the low profile helmet 10 to fit closer to the top of the wearer's head. The close fit of the helmet 10 minimizes the weight of the helmet itself, and provides excellent stability of the helmet on the head.

The outer shell 11 further includes added shock absorbing means 25 that is preferably integral to the outer shell 11. The added shock absorbing means 25 includes a first extension 27 and a second extension 29 in perpendicular relationship with the first extension 27. Like the outer shell 11, the added shock absorbing means 25 is constructed of a substantially rigid impact resistant material and disposed on the outer shell 11 in order to give added protection to the head of the wearer such that the low profile helmet 10 is suitable for use in hazardous areas in industry and mines.

As illustrated, the first extension 27 horizontally extends along the central portion of the center section 15. The second extension 29 is disposed in perpendicular relationship to the first extension 27. The second extension 29 vertically extends along the central portion of the center section 15 and extends such that a first end 29A is approximately adjacent the front section 17 and a second end 29B is approximately adjacent the rear section 19. As stated, the extensions 27, 29 forming the added shock absorbing means 25 give added protection to the head of the wearer during use.

Figure 3:
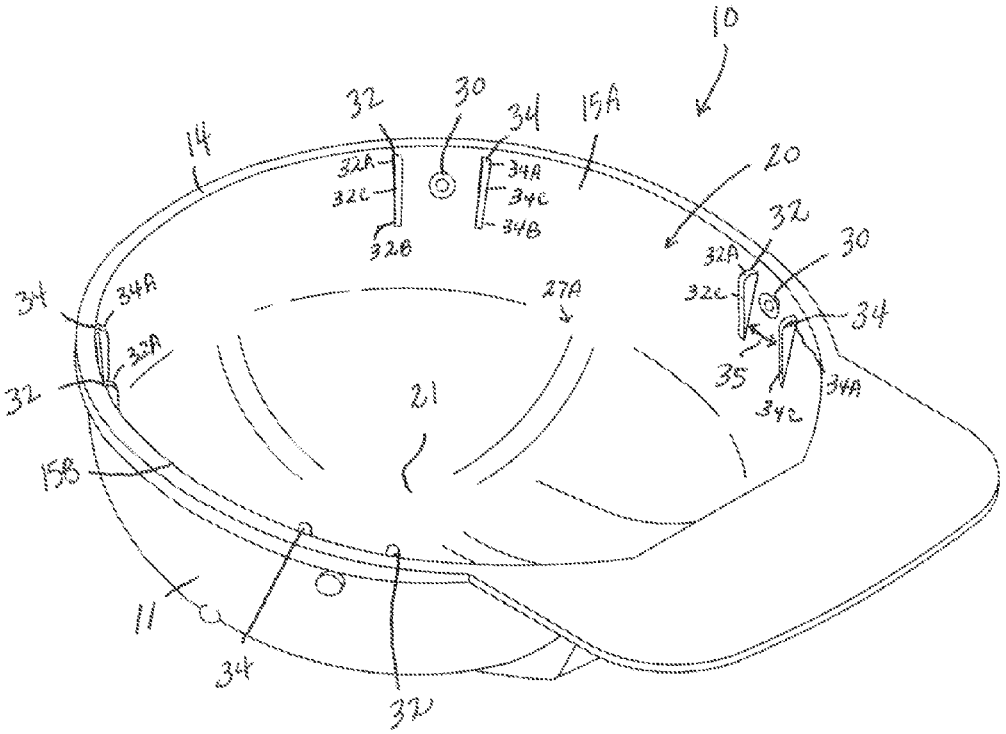
FIG. 3 is a perspective view of the interior of the low profile protective helmet illustrated in FIG. 1, and further shows the preferred embodiment of the present invention, a fastener means for low profile protective helmet internal suspension system.

FIG. 3 shows the outer shell's interior surface 20. In particular, a plurality of fasteners 30 are spaced along a bottom edge 14 of the low profile helmet 10. These fasteners 30 are each for connecting to a prior art suspension liner 40 (FIG. 4) as will be further discussed, and secures the suspension liner within the hat against relative upward movement with respect to the shell 11, and further supports the shell 11 in spaced apart relation about the wearer's head. In the preferred embodiment, and as best shown in FIG. 3, two of these fasteners 30 are spaced apart on a first side 15A of the center section 15, and two of the fasteners 30 are spaced apart on a second side 15B of the center section 15.

Fasteners 30 can be pins, snaps, buttons, rivets or other fastening means known in the art.

As is known, the suspension liner 40 is releasably connected directly to the fasteners 30 in the interior 20 of the shell 11. The liner 40 engages the wearer's head (not shown) and is generally formed of a central or dome member 42 that is adapted to contact the top of the wearer's head, and integral head straps 45 that include fasteners 47 adapted to cooperate with the fasteners 30. To further facilitate an understanding of the present invention, it will be described in conjunction with the suspension liner just described; as the description proceeds however, it will be obvious that the present invention may be used in conjunction with various head and crown suspension liners of other construction designs and it is in fact intended to do so.

With the low profile protective helmet, as previously discussed, the distal point 21 of the helmet is approximately one (1) inch closer to the top of the wearer's head than with the prior art bulk helmets. As a result, there naturally exists less space between the top of the wearer's head and the distal point 21. The Inventor found the attached prior art suspension liners less stable in the low profile helmet versus the bulk helmets, again, due to the closer fit to the wearer's head. More particularly, the Inventor found that the integral head straps 45 attached to the fasteners 30 of the low profile helmet would more often adjust or move during application or use. Undesirable movement of the integral head straps can change the location of the central or dome member 42, directly causing the low profile protective helmet fit to be less stable.

Figure 4:
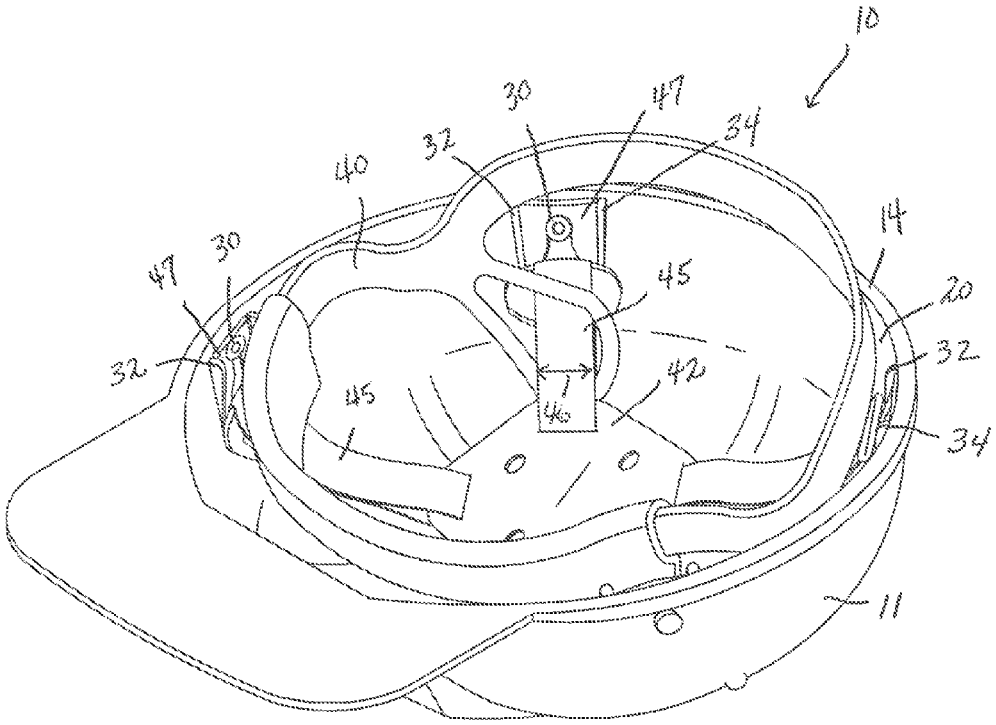
FIG. 4 is a perspective view of the interior of the low profile helmet of FIG. 3, and illustrates a suspension liner connected to the fasteners in the interior of the low profile protective helmet.

Referring to FIGS. 3 and 4, the interior surface 20 of the present invention further includes first and second rib members 32, 34, respectively, adjacent each fastener 30 such that each fastener 30 is disposed between the pair of rib members 32, 34. The rib members 32, 34 are disposed adjacent the bottom edge 14 and are preferably integral to the interior surface 20 of the shell 11.

Each rib member 32, 34 is a raised ridge on the interior surface 20 that stabilizes the suspension liner 40. Referring to FIG. 3, each raised rib member 32, 34 having a first end 32A, 34A, and a second end 32B, 34B, the first end 32A, 34A disposed next to the bottom edge 14 and the second end 32B, 34B is disposed between the bottom edge 14 and a distal end 27A of the first extension 27. As illustrated, the first end 32A, 34A is raised from the interior surface 20 and the second end 32B, 34B, is approximately coplanar the interior surface 20 such that a top edge 320, 340, defines a slanted surface, each of the rib members 32, 34 being downwardly slanted from the first end 32A, 34A, toward the second end 32B, 34B.

As should now be understood, the rib members 32, 34 restrict the side-to-side movement of the integral head straps 45 by the retaining action of the rib members 32, 34 as the integral head straps 45 are attached to each fastener 30. As illustrated, with the present invention, only a small amount of movement of the head straps 45 is permitted in order to properly secure the liner suspension in place. In particular, the rib members 32, 34 define an equal spacing 35 therebetween (See FIG. 3) such that the spacing 35 is approximately equal to the width 46 (See FIG. 4) of the integral head straps 45.

From the foregoing, it is seen that the present invention provides a low profile protective helmet construction or attachment which fully accomplishes its intended objects and is well adapted to meet practical conditions of manufacture, installation and use.

While the best mode for carrying out the invention has been described, those familiar with the art to which this invention relates will recognize various alternative designs and embodiments for practicing the invention. Thus, the above-described preferred embodiment is intended to be illustrative of the invention which may be modified within the scope of the appended claims.

I claim:

1. A low profile protective helmet comprising:

an outer shell of a substantially rigid impact resistant material, said outer she having generally spherical contours to encompass the upper part of a wearer's head, wherein said outer shell is integrally formed by a center section, a front section and a rear section, wherein said outer shell further includes an interior surface that is immediately adjacent the top of the wearer's head when the helmet is being worn, said interior surface includes a plurality of fasteners that are spaced along a bottom edge of the protective helmet, said fasteners for attaching an internal suspension padding, first and second rib members fixed to the interior surface and adjacent to each of said plurality of fasteners such that each fastener is disposed between said first and second rib member, wherein said first and second rib members each having a first end and a second end, the first end is next to the bottom edge and the second end disposed between the bottom edge and a distal end of a horizontal extension disposed along a central portion of the center section, wherein the first end is raised from the interior surface and the second end is approximately coplanar the interior surface such that a top edge of each of the first and second rib members define a slanted surface that downwardly slants from the first end towards the second end.

2. The low profile helmet as recited in claim 1, wherein said first and second rib members define an equal spacing therebetween such that a width of an integral head strap of a suspension liner is approximately equal to said spacing.

3. The low profile helmet as recited in claim 2, wherein two of said plurality of fasteners are spaced apart on a first side of said center section and wherein two of said plurality of fasteners are spaced apart on a second side of said center section.

4. The low profile helmet as recited in claim 3, wherein each of said first and second rib members is a raised ridge for stabilizing a strap portion of the internal suspension padding.

5. The low profile helmet as recited in claim 4, wherein said first and second rib members are integral to said interior surface.

6. A low profile protective helmet comprising:

an outer shell having generally spherical contours to encompass the upper part of a wearer's head, said outer shell further includes an interior surface that is immediately adjacent the top of the wearer's head when the helmet is being worn, a plurality of fasteners that are spaced along said interior surface and adjacent a bottom edge of said outer shell, said fasteners for attaching an internal suspension padding, wherein at least two of said plurality of fasteners are spaced apart on a first side of a center section of said shell, and wherein at least two of said plurality of fasteners are spaced apart on a second side of said center section, wherein each of said plurality of fasteners is sandwiched between a pair of rib members fixed to the interior surface, each of said rib members having a first end, a second end and a top slanted edge, wherein the first end is next to said bottom edge and the second end disposed between the bottom edge and a distal end of a horizontal extension disposed along a central portion of the center section, and wherein the first end is raised from the interior surface and the second end is approximately coplanar the interior surface such that said top slanted edge defines slanted surface where the first end downwardly extends towards the second end.

7. The low profile helmet as recited in claim 6, wherein said pair of rib members define a spacing therebetween such that a width of a head strap of the suspension padding is approximately equal to said spacing.

8. The low profile helmet as recited in claim 7, wherein each of said pair of rib members is a raised ridge for stabilizing the head strap of the suspension padding.

9. The low profile helmet as recited in claim 8, wherein said pair of rib members is integral to said interior surface.

* * * * *